US005791158A

United States Patent [19]

Klintworth et al.

[11] Patent Number: 5,791,158

[45] Date of Patent: Aug. 11, 1998

[54] INTERNALLY FIRED GENERATOR WITH IMPROVED SOLUTION FLOW

[75] Inventors: Michael W. Klintworth, Covington; U. Tina Kim, Dayton, both of Ohio

[73] Assignee: Gas Research Institute, Chicago, Ill.

[21] Appl. No.: 585,152

[22] Filed: Jan. 11, 1996

Related U.S. Application Data

[63] Continuation-in-part of Ser. No. 478,981, Jun. 7, 1995.

[51] Int. Cl.[6] ..... F25B 33/00

[52] U.S. Cl. ..... 62/497; 62/495

[58] Field of Search ..... 62/497, 476, 495, 62/101, 141

[56] References Cited

U.S. PATENT DOCUMENTS

| | | | |
|---|---|---|---|
| 2,201,362 | 5/1940 | Bergholm | 62/497 |
| 2,203,074 | 6/1940 | Anderson | 62/497 |
| 2,623,366 | 12/1952 | Edel | 62/497 |
| 3,254,507 | 6/1966 | Whitlow | 62/497 |
| 3,284,610 | 11/1966 | Grubb | 219/279 |
| 3,295,334 | 1/1967 | Hultgren | 62/148 |
| 3,323,323 | 6/1967 | Philips | 62/497 |
| 3,407,625 | 10/1968 | McDonald | 62/476 |
| 3,580,013 | 5/1971 | Ballard | 62/148 |
| 3,648,481 | 3/1972 | Ando et al. | 62/476 |
| 3,808,834 | 5/1974 | Eber | 62/497 |
| 3,828,575 | 8/1974 | Malloskey et al. | 62/476 |
| 5,230,225 | 7/1993 | George, II et al. | 62/476 |

*Primary Examiner*—William Doerrler

*Attorney, Agent, or Firm*—Speckman Pauley Petersen & Fejer

[57] ABSTRACT

An absorption cooling system generator with an internal fire tube or combustion chamber is disclosed. The fire tube includes at least one radially projecting heat transfer member on its interior surface that interacts with hot combustion gases. A minimum quantity of refrigerant solution is maintained in the generator by a leveling chamber. The leveling chamber is a refrigerant solution reservoir connected to the generator to maintain substantial equilibrium of the fluid levels within the generator and reservoir. The leveling chamber includes a standpipe. When the refrigerant solution level is above the standpipe, solution may flow out of the leveling chamber and the generator to an absorber. If the solution level falls below the standpipe, set at a predetermined level, solution will not flow out of the generator. Thus, the generator will maintain a minimum, predetermined solution level. In addition, a baffle coil tube and a helical baffle provide an improved solution flow in the generator.

14 Claims, 2 Drawing Sheets

INTERNALLY FIRED GENERATOR WITH IMPROVED SOLUTION FLOW

CROSS-REFERENCE TO RELATED APPLICATION

The present application is a continuation-in-part of the pending patent application by the same inventors, Michael W. Klintworth and U. Tina Kim, U.S. Ser. No. 08/478,981, filed Jun. 7, 1995. The entire disclosure of the pending application including the drawings and appendices are incorporated herein by reference as if set forth fully in this application.

FIELD OF THE INVENTION

The present invention relates generally to absorption cooling systems and, more particularly, concerns an improved internally fired vapor generator.

BACKGROUND OF THE INVENTION

Absorption cooling systems are well known. In a simple absorption cooling system, a generator heats a refrigerant solution comprising a "strong" or concentrated solution of a more-volatile or refrigerant component in a less-volatile or solvent component. The heat drives the refrigerant from the strong solution to separate a refrigerant vapor, leaving a "weak solution" that is depleted of the refrigerant.

Where the refrigerant solution is a solution of a non-volatile solute in a volatile solvent, such as lithium bromide in water, the "weak solution" contains a higher concentration of the solute but a lower concentration of the solvent than the corresponding "strong solution." Where the refrigerant solution is a solution of a more-volatile solute in a less-volatile solvent, such as ammonia in water, the "weak solution" is depleted of ammonia and is mostly water, while the "strong solution" is a more concentrated ammonia solution.

After being separated in the generator, the refrigerant vapor leaves the generator, flowing to a condenser. In the condenser the refrigerant vapor is maintained under pressure and allowed to cool. As a result, the vapor condenses to form a refrigerant liquid. After leaving the condenser, the refrigerant liquid flows to an evaporator. The evaporator relieves the pressure on the refrigerant liquid and the refrigerant evaporates, again forming a vapor. This evaporation of the refrigerant draws heat from a heat load and creates the cooling effect of a refrigerator or air conditioner.

The refrigerant vapor from the evaporator flows to an absorber. The weak solution remaining in the generator also flows to the absorber. In the absorber, the weak solution reabsorbs the refrigerant, reforming the strong solution.

Typically, the absorber is arranged so that the weak solution enters the top of the enclosed absorber and flows downward. The refrigerant vapor enters the bottom of the absorber and flows upward. In counterflow with the refrigerant vapor, the weak solution absorbs the refrigerant and becomes a strong solution. The strong solution then flows back to the generator and the cycle repeats.

The heat of the generator drives the refrigerant vapor from the strong solution. An ideal generator would drive all refrigerant vapor from the solution. In addition, because the heat of the generator may tend to boil the less volatile solvent, the ideal generator generates only refrigerant vapor and not solvent vapor. To promote these goals, the generator must effectively circulate the refrigerant solution and the refrigerant vapor in heat exchange relationship with the generator's heat source. Accordingly, those skilled in the art have sought a generator that more effectively circulates solution and vapor than prior generators.

Also, in prior absorption cooling systems, generators often encountered conditions that undesireably lowered the solution level in the generator. For example, when the absorption cooling system is first started, the solution level may be undesireably low in the generator. Also, if a pump or other system component malfunctions, the generator may not be replenished with solution from the system.

When the composite refrigerant level in the generator is too low, the generator can quickly overheat. To prevent a low refrigerant level and the resulting overheating of the generator, temperature sensing devices or electronic control circuits have been employed. One example of an electronic generator level control is disclosed in U.S. Pat. No. 3,580,013.

Many prior generators do not effectively insulate the generator heat source, resulting in unnecessary energy loss. Also, many prior generators do not efficiently utilize energy. An efficient generator avoids unnecessary heat loss and conserves energy by efficiently utilizing the energy supplied to the generator. Those skilled in the art continually seek to improve the energy efficiency of a generator.

Therefore, an object of the present invention is to provide a generator that effectively circulates solution and vapor to efficiently generate refrigerant vapor.

In addition, an object of the present invention is to provide an absorption cooling system that maintains a minimum level of solution in the generator to prevent the generator from overheating.

Also, an object of the present invention is to provide a generator that avoids unnecessary heat loss from the heat source.

Further, an object of the present invention is to provide a generator that efficiently utilizes the energy supplied to the generator.

Finally, an object of the present invention is to provide a generator that is simple and economical to manufacture.

SUMMARY OF THE INVENTION

The invention relates to an absorption refrigeration system comprising a generator, condenser, evaporator, and multiple absorbers. A leveling chamber maintains a minimum quantity of solution in the generator to prevent overheating. The minimum level is predetermined by positioning a conduit within the leveling chamber.

The invention also discloses an internal heat source for the generator. The heat source comprises a fire tube including a burner and internal, radially projecting heat exchange fins. Also, a baffle coil tube, a helical baffle, and a plurality of analyzer plates operate to effectively distribute the solution and vapor in the generator.

The disclosed system provides several advantages over the prior art. First, the heat source is internalized and insulated by the exterior portions of the generator. Therefore, the generator loses less heat and is more energy efficient than externally-heated generators. The heat exchange fins are located within the fire tube and reduce corrosion because less surface area is exposed to the surrounding refrigerant solution. Further, the present invention maintains a minimum level of solution in the generator to prevent overheating. Finally, the disclosed generator has a simplified structure, resulting in lower manufacturing costs than previous solution level-maintaining systems.

These and other advantages will become apparent as this specification is read in conjunction with the accompanying drawings and appended claims.

Figure 1:
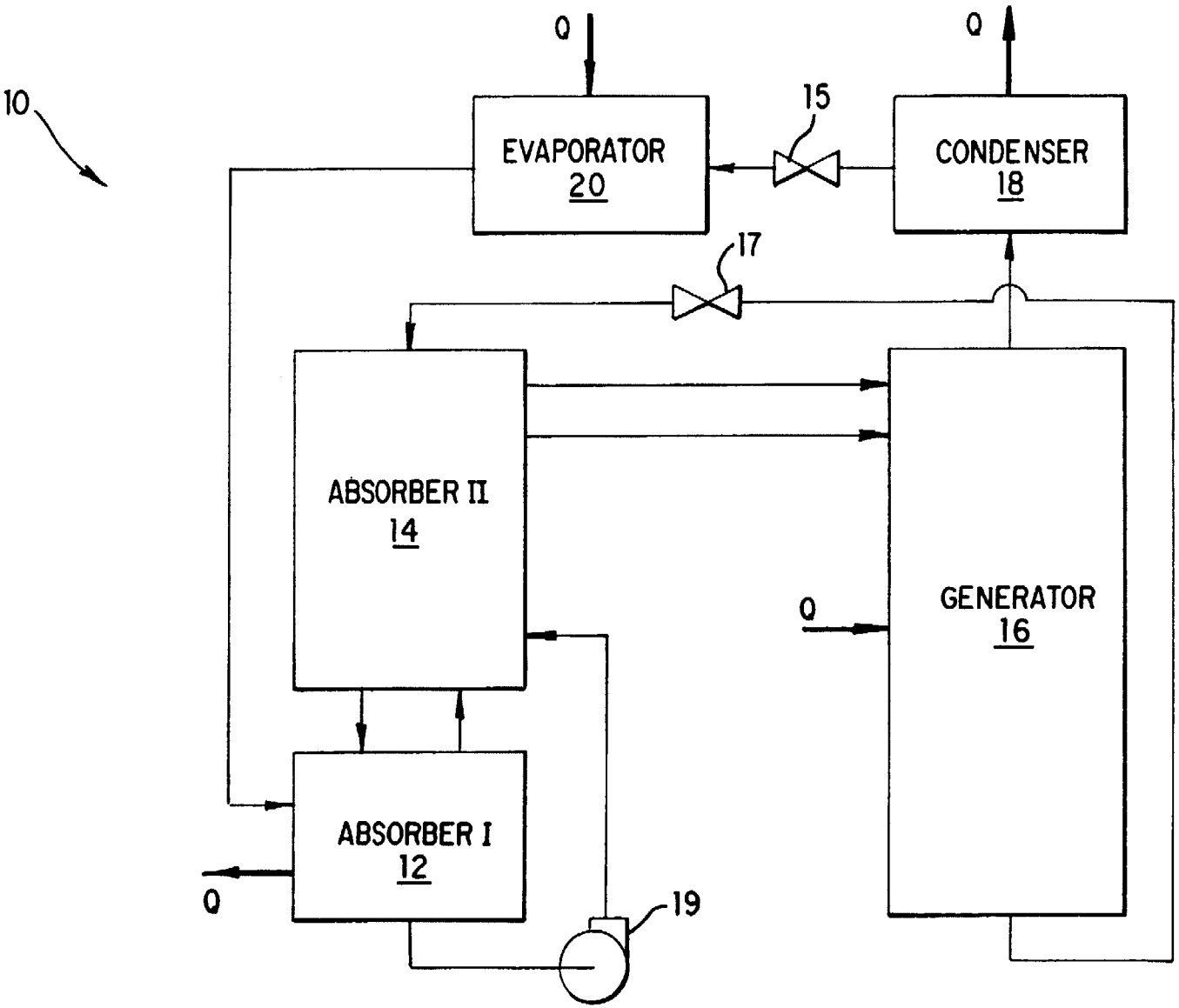
FIG. 1 is a schematic diagram of an absorption refrigeration system utilizing the generator of the present invention.

In the Figures, the following reference characters are used:

| | |
|---|---|
| 10 | absorption cooling system |
| 12 | first absorber (Absorber I) |
| 14 | second absorber (Absorber II) |
| 15 | first expansion valve |
| 16 | generator |
| 17 | second expansion valve |
| 18 | condenser |
| 19 | strong solution pump |
| 20 | evaporator |
| 22 | vessel |
| 24 | rectifier |
| 26 | boiler section |
| 28 | first strong solution inlet |
| 30 | second strong solution inlet |
| 32 | reflux coil |
| 33 | solution reservoir |
| 34 | lower analyzer plates |
| 35 | upper analyzer plates |
| 36 | vapor outlet |
| 37 | lower vapor conduit |
| 38 | internal fire tube |
| 39 | helical baffle |
| 40 | baffle coil tube |
| 41 | solution conduit |
| 42 | burner |
| 43 | upper vapor conduit |
| 44 | heat exchange fins |
| 46 | insulation center plug |
| 48 | flue gas outlet |
| 50 | fluid inlet |
| 52 | fluid outlet |
| 54 | leveling chamber |
| 56 | leveling chamber standpipe |
| 60 | valve |

DETAILED DESCRIPTION OF THE INVENTION

Although the invention is described in connection with one or more preferred embodiments, the invention is not limited to those embodiments. The invention includes alternatives, modifications and equivalents that are included in the spirit and scope of the appended claims.

As shown in FIG. 1, one embodiment of the present invention operates in the absorption cooling system 10. The absorption cooling system 10 includes a generator 16, a condenser 18, an evaporator 20, a first absorber 12 (Absorber I), and a second absorber 14 (Absorber II).

When it enters the generator, the strong refrigerant solution has at least substantially the maximum concentration of dissolved refrigerant vapor. The refrigerant solution is heated in the generator 16, as represented by the letter Q and the arrow indicating the direction of heat transfer. The heat distills the refrigerant from the solution to form a free refrigerant vapor and deplete the remaining liquid of refrigerant. The remaining liquid is now a "weak solution." The refrigerant vapor leaves the generator and flows to the condenser 18.

In the condenser 18, the refrigerant vapor is maintained under pressure and allowed to cool. As a result, the refrigerant vapor condenses to become a liquid. The heat of condensation Q is removed to a heat sink, which can be anything capable of absorbing heat.

The liquid refrigerant then flows to the evaporator 20. As the liquid refrigerant flows to the evaporator 20, the first expansion valve 15 relieves the pressure on the refrigerant. The refrigerant evaporates in the evaporator 20, absorbing heat Q into the system from a heat load to produce the cooling effect of the present system.

After the generator 16 drives the refrigerant from the strong solution, the weak solution exits the generator 16 and flows to Absorber II 14. A second expansion valve 17 regulates the pressure of the flow of the weak solution to Absorber II. The refrigerant vapor flows to Absorber I 12 from the evaporator 20. In Absorber I and Absorber II, the vapor is reabsorbed in the weak solution to create the strong solution.

Absorber I receives vapor from the evaporator 20 and an intermediate solution from Absorber II. Absorber I circulates the solution downward and the vapor upward in helical passages to absorb the vapor in the intermediate solution to create the strong solution. Also, Absorber I circulates a coolant upward in helical passages in heat exchange relationship with the solution and the vapor (removing heat Q from the absorber) to facilitate absorption of the vapor into the solution. Absorber I releases excess vapor to Absorber II. Absorber I also circulates the strong solution to Absorber II.

Absorber II circulates the hot, weak solution downward and the vapor received from Absorber I upward to absorb the vapor in the solution. The strong solution from Absorber I is pumped by the strong solution pump 19 to Absorber II. Absorber II circulates the cooler, strong solution in heat exchange relationship with the hotter, weak solution from the generator 16. The weak solution transfers heat to the strong solution to preheat the strong solution before it reaches the generator 16. The strong solution also facilitates absorption of vapor into the weak solution by absorbing the heat of absorption in Absorber II. Some of the strong solution is diverted in Absorber II and flows to the generator.

The remaining strong solution continues to circulate in heat exchange relationship with the hot, weak solution, causing the strong solution to become superheated. As it becomes superheated, the strong solution releases at least some vapor. The strong solution and vapor mixture then flows to the generator 16 via a second conduit between Absorber II and the generator 16. Because the strong solution has already been superheated to release at least some vapor, the load on the generator 16 is lightened and the temperature differential between the weak and strong solution may be utilized.

Figures 2, 3:
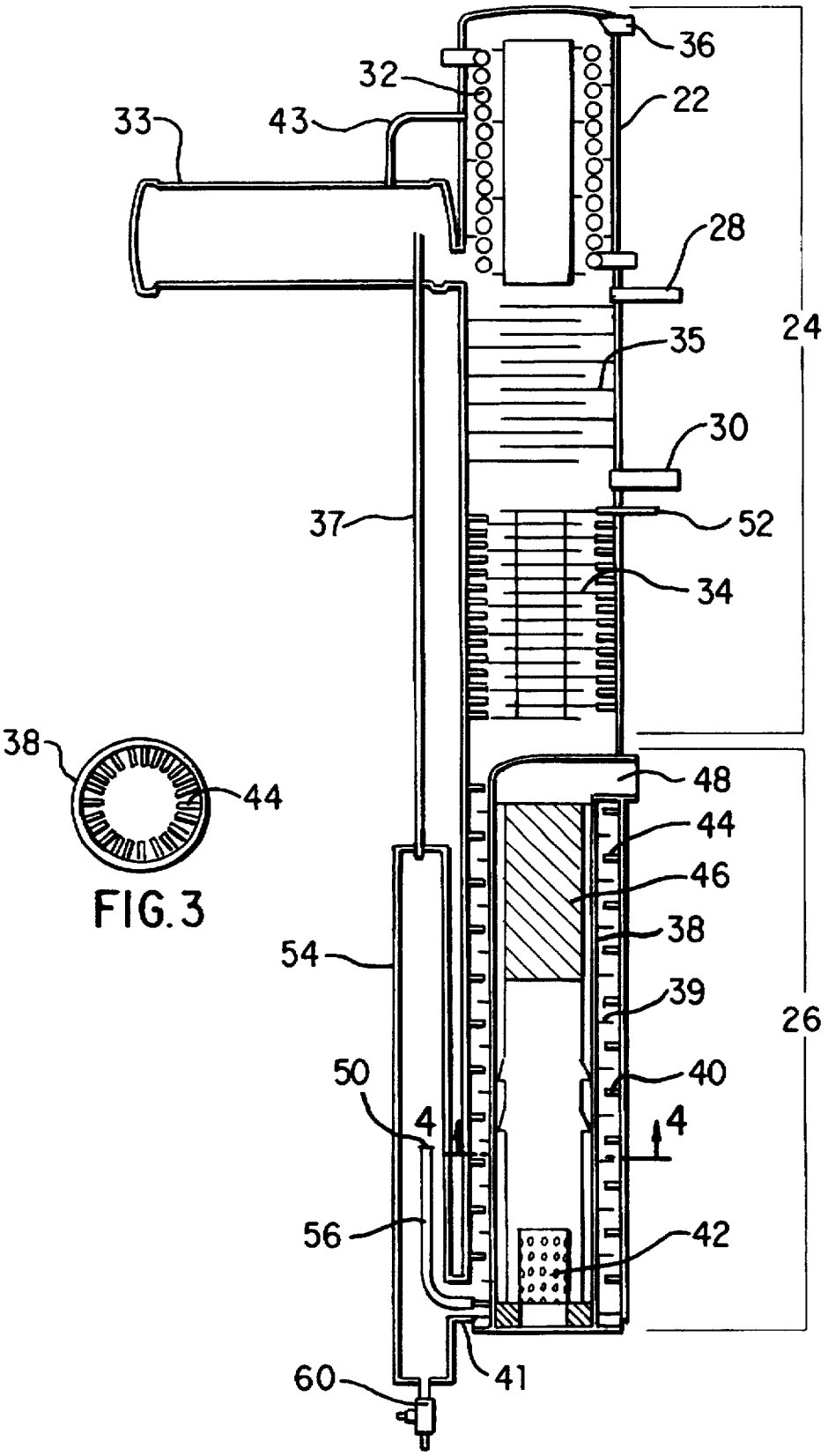
FIG. 2 is a diagrammatic longitudinal section of the generator and leveling chamber apparatus according to the present invention.
FIG. 3 is a sectional view taken at line 4—4 of FIG. 4.

As shown in FIG. 2, the generator 16 is vertically oriented and divided into an upper portion and lower portion. The upper portion is the rectifier 24 and the lower portion is the boiler section 26. The generator is contained in a vessel 22.

The rectifier 24 includes one or more solution inlets 28 and 30, a ref lux coil 32, a solution reservoir 33, a plurality of analyzer plates 34 and 35, a vapor outlet 36, and vapor conduits 37 and 43. The boiler section 26 includes an internal fire tube 38, a helical baffle 39, a baffle coil tube 40, and a solution conduit 41. The internal fire tube 38 includes a heat source or burner 42, radial vertical heat exchange fins 44 (also shown in FIG. 3), an insulation center plug 46, and a flue gas outlet 48. The baffle coil tube 40 is a closely spaced helical spiral tube with a fluid inlet 50 and a fluid outlet 52.

The reservoir or leveling chamber 54 is connected to the generator 16 by the vapor conduit 37 and the solution conduit 41. The leveling chamber 54 includes a leveling chamber standpipe 56 and may be drained by the valve 60.

In operation, the generator 16 functions as a fractional distillation column, separating the non-volatile component, such as ammonia, from the less-volatile compound of the composite refrigerant solution. Essentially, the generator 16 drives refrigerant vapor from the previously described strong solution. The generator rectifier 24 receives strong solution through one or more solution inlets 28 and 30. As shown in FIG. 1, the solution entering the solution inlets 28 and 30 is the strong refrigerant solution from Absorber II. Referring to FIG. 2, the strong solution from solution inlet 30 trickles through the lower analyzer plates 34 into the boiler section 26. The strong solution from solution inlet 28 trickles through both the upper analyzer plates 35 and the lower analyzer plates 34 into the boiler section 26.

Throughout the generator 16, but particularly within the boiler section 26, the strong refrigerant solution is heated to distill out the volatile phase of the refrigerant. Heat is added to the refrigerant solution by the internal fire tube 38. Within the fire tube 38, the burner 42 creates heat by burning a fuel such as natural gas. Of course, other fuels may be used.

Hot combustion gases from the burner 42 flow upward outside the insulation center plug 46. The insulation center plug 46 forces the hot combustion gases into contact with the heat exchange fins 44, also shown in FIG. 3, and against the interior surface of the fire tube 38. Thus, the refrigerant solution contacting the exterior surface of the fire tube 38 is heated. Combustion gases exit the fire tube 38 at the flue gas outlet 48.

The internal heat exchange fins 44 of the fire tube 38 provide several advantages. For example, insulation of the entire generator assembly 10 is made easier because the heat source is surrounded by the fire tube 38, the refrigerant solution within the boiler section 26, the baffle coil tube 40, and the generator vessel 22. This results in less heat loss and higher efficiency. Further, heat transfer to the exterior surface of the fire tube 38 is increased because the most surface area is provided on the flue gas side, where heat transfer is less efficient than on the refrigerant side. Also, in the case of corrosive refrigerant solutions, corrosion is reduced on the exterior surface of the fire tube 38 because there is less surface area contacting the refrigerant solution.

As the refrigerant solution is heated in the boiler section 26, the volatile phase is distilled out of the solution. This volatile phase rises through rectifier 24. In the rectifier 24, the analyzer plates 34 and 35 aide in the distillation process by providing multiple surfaces of varying temperature. In this case, the upper portion of the rectifier 24 is cooler than the lower portion. The surfaces created by the analyzer plates 34 and 35 help condense the less-volatile phase of the composite refrigerant, which then trickles downward to insure the purity of the volatile refrigerant vapor exiting the generator 16 through the vapor outlet 36. The reflux coil 32 also acts as a heat sink to condense the less-volatile phase of the composite refrigerant solution, increasing the efficiency of phase separation. Thus, in the case of an ammonia/water solution, water will be removed from the ammonia vapor as it rises through the rectifier 24 to the vapor outlet 36.

As shown in FIG. 1, the vapor can then pass to a condenser 18 and evaporator 20 for use in refrigeration. However, as the vapor is distilled, weakened refrigerant solution remains in the boiler section 26.

The boiler section 26 is connected to leveling chamber 54 by the solution conduit 41, and to the upper portion of the rectifier 24 by the lower vapor conduit 37. The solution conduit 41 allows the weak solution from the boiler section 26 to flow into the leveling chamber 54. The solution conduit 41 and lower vapor conduit 37 equalize pressure between the vessel 22 and the leveling chamber 54, causing the fluid level in each to equalize. In addition, the lower vapor conduit 37 transfers any vapor generated in the leveling chamber 54 to the solution reservoir 33. The vapor may flow to the upper rectifier 24 through the upper vapor conduit 43.

In the leveling chamber 54, if the level of the weak solution is above the fluid inlet 50, the weak solution flows into the leveling chamber standpipe 56. The leveling chamber standpipe 56 carries the weak solution to the baffle coil tube 40 in the boiler section 26. The pressure of the generator 16 and convection due to the heating of the weak solution cause the weak solution to travel upward through the baffle coil 40. The baffle coil tube 40 circulates the weak solution upward in the boiler section 26 and eventually the rectifier 24. The weak solution exits the baffle coil tube 40 and the generator 16 at the fluid outlet 52. The weak solution then flows to Absorber II, as previously described.

In the boiler section 26, the baffle coil tube 40 and the helical baffle 39 provide a tortuous path for fluid flow within the boiler section 26. Both the baffle coil tube and the helical baffle 39 have a closely spaced, helical design. The baffle coil tube 40 spirals upward in the boiler section 26 adjacent the interior of the exterior wall of the generator vessel 22. The helical baffle 39, a flat material spiraled in the shape of a spring, spirals up the exterior of the internal fire tube 38. Both the baffle coil tube 40 and the helical baffle extend into the annular space between the internal fire tube 38 and the exterior wall of the generator vessel 22. Accordingly, the strong solution must meander over both the baffle coil tube 40 and the helical baffle 39 as it flows downward through the boiler section 26.

The baffle coil tube 40 directs the downward flowing strong solution toward the internal fire tube 38. Rather than flowing directly downward, the strong solution then meets a run of the helical baffle 39 and is directed away from the internal fire tube 39. The next run of the baffle coil tube again directs the strong solution back into contact with the internal fire tube 39. Accordingly, the downward flow of strong solution is slowed and greatly agitated. This allows the strong solution to become sufficiently heated and agitated so that it releases the maximum amount of refrigerant vapor.

The weak solution in the baffle coil tube 40 continues upward to the rectifier 24 where it again spirals around the interior of the exterior wall of the generator vessel 22. In the rectifier section 24, the baffle coil tube 40 provides an additional heat exchange between the incoming strong refrigerant solution and the hotter, exiting weak solution. The hot weak solution preheats the cooler strong solution before the strong solution enters the boiler section 26.

The weak solution will exit the leveling chamber 54 only when the solution level in the leveling chamber 54 is higher than the fluid inlet 50. Because the fluid levels within the generator vessel 22 and the leveling chamber 54 are substantially equal, the minimum fluid level within the generator vessel 22 normally will be above the fluid inlet 50. Thus, the refrigerant fluid level within the vessel 22 will be maintained no lower than the opening of the fluid inlet 50. If the weak solution level within the vessel 22 drops below the fluid inlet 50, weak solution fluid flow out of the leveling chamber 54 will stop. Weak solution flow out of the leveling chamber 54, and correspondingly the generator 16, will not resume until the fluid level in the vessel 22 rises above the level of the fluid inlet 50 in the leveling chamber 54. Accordingly, the generator vessel 22 will maintain a minimum amount of refrigerant solution at all times.

Many other variations will suggest themselves to one of ordinary skill in the art. These changes and additions may be carried out without departing from the present invention. For example, the leveling chamber 54 could be any height, volume, or size depending upon the refrigerant solution turnover rate within the generator. A high turnover rate, with associated higher heat, may require a larger capacity leveling chamber and/or a higher fluid inlet to avoid overheating the generator. Likewise, the height, width, or volume of the generator vessel 22 will vary with the application or composite fluid refrigerant used.

Another embodiment may alter or eliminate the helical baffle coil 40 and corresponding fluid outlet 52. The fluid conduit 41 and vapor conduit 37 could be enlarged to more quickly reach equilibrium between the fluid levels within the generator vessel 22 and leveling chamber 54.

In addition, it is readily apparent that the leveling chamber concept of the present invention could be used with most conventional generators presently available. Likewise, many heat sources currently available could be substituted for the internal fire tube design of the present invention.

Thus, an internally fired generator apparatus has been shown with a simplified construction and fewer maintenance problems than previous systems. We expect that this apparatus will be more efficient than prior apparatus, will cost less to manufacture, and waste less energy than prior apparatus. The generator of the present invention eliminates the problem of overheating caused by a low level of solution. Also, the present invention effectively distributes the solution and vapor within the generator. Thus, one or more objects of the present invention have been met by the illustrated apparatus.

Many alterations, variations, and combinations are possible that fall within the scope of the present invention. Although the preferred embodiments of the present invention have been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

What is claimed is:

1. An absorption refrigeration system vapor generator and burner unit comprising:

a substantially enclosed vessel having a wall defining an interior surface, a lower and an upper portion, at least one inlet for receiving a strong refrigerant solution, and at least one outlet for exhausting refrigerant vapors;

a fire tube having a wall defining an interior surface, an exterior surface, a lower and an upper portion, the fire tube located within the lower portion of the vessel, the fire tube having at least one radially projecting heat transfer member on the interior surface of the fire tube for interaction with hot combustion gases;

a burner for burning a fuel, said burner located within the lower portion of the fire tube;

an outlet conduit connected to the fire tube for exhausting combustion gases outside the vessel;

a helical baffle coil tube spaced apart from and opposing the exterior of the fire tube, the baffle coil tube located adjacent the interior surface of the vessel, the baffle coil tube including an inlet and an outlet for transferring weak refrigerant solution from the vessel; and a helical baffle member located adjacent the exterior of the fire tube.

2. The generator unit of claim 1, wherein the outlet conduit for exhausting the combustion gases is located near the upper portion of the fire tube.

3. The generator unit of claim 1, wherein the heat transfer member comprises a plurality of metallic fins.

4. The generator unit of claim 3, wherein the upper portion of the tube member contains a quantity of insulation for forcing the combustion gases against the heat transfer members and the interior surface of the fire tube.

5. An absorption of refrigeration system vapor generator and burner unit comprising:

a substantially enclosed vessel having a wall defining an interior surface, at least one inlet for receiving a refrigerant solution, a lower portion for heating the refrigerant solution to create a refrigerant vapor, and at least one outlet for exhausting the refrigerant vapor;

a fire tube having a wall defining an interior surface, an exterior surface, a lower and an upper portion, the fire tube located within the lower portion of the vessel and containing a heat source for heating the refrigerant solution;

a leveling chamber containing a quantity of refrigerant solution, the leveling chamber having a solution conduit connecting and allowing refrigerant solution flow between the leveling chamber and the lower portion of the vessel to equalize the refrigerant solution level in the leveling chamber and the lower portion of the vessel, a baffle member located between the exterior of the fire tube and the interior surface of the lower portion of the vessel, the baffle member obstructing the downward flow of a refrigerant solution in the lower portion of the vessel.

6. The generator of claim 5, wherein the baffle member deflects the downward flow of the refrigerant solution onto the exterior surface of the fire tube.

7. The generator of claim 5, wherein the baffle member is helical in shape.

8. An absorption of refrigeration system vapor generator and burner unit comprising:

a substantially enclosed vessel having a wall defining an interior surface, at least one inlet for receiving a refrigerant solution, a lower portion for heating the refrigerant solution to create a refrigerant vapor, and at least one outlet for exhausting the refrigerant vapor;

a fire tube having a wall defining an interior surface, an exterior surface, a lower and an upper portion, the fire tube located within the lower portion of the vessel and containing a heat source for heating the refrigerant solution;

a leveling chamber containing a quantity of refrigerant solution, the leveling chamber having a solution conduit connecting and allowing refrigerant solution flow between the leveling chamber and the lower portion of the vessel to equalize the refrigerant solution level in the leveling chamber and the lower portion of the vessel, a helical baffle coil tube located between the exterior of the fire tube and the interior surface of the lower portion of the vessel, the helical baffle coil tube obstructing the downward flow of a refrigerant solution in the lower portion of the vessel, the helical baffle coil tube having an inlet and an outlet for transferring a weak refrigerant solution from the vessel.

9. The generator of claim 8, wherein the helical baffle coil tube deflects the downward flow of the refrigerant solution onto the exterior surface of the fire tube.

10. The generator of claim 8, further including a helical baffle member located between the exterior of the fire tube and the interior surface of the lower portion of the vessel.

11. The generator of claim 10, wherein the helical baffle coil tube is located adjacent the interior surface of the vessel and the helical baffle member is located adjacent the exterior of the fire tube.

12. An absorption refrigeration system vapor generator and burner unit comprising:

a substantially enclosed vessel having a wall defining an interior surface at least one inlet for receiving a refrigerant solution, a lower portion for heating the refrigerant solution to create a refrigerant vapor, and at least one outlet for exhausting the refrigerant vapor;

a fire tube having a wall defining an interior surface an exterior surface, a lower and an upper portion, the fire tube located within the lower portion of the vessel and containing a heat source for heating the refrigerant solution;

a leveling chamber containing a quantity of refrigerant solution, the leveling chamber having, a solution conduit connecting and allowing refrigerant solution flow between the leveling chamber and the lower portion of the vessel;

a refrigerant solution outlet located above the solution conduit and allowing outflow of refrigerant solution from the generator only when the level of the refrigerant solution in the vessel is above a predetermined minimum level.

13. The generator of claim 12, wherein the refrigerant solution outlet is located within the leveling chamber and receives a weak refrigerant solution that has been substantially depleted of refrigerant vapor.

14. The generator of claim 12, further including a helical baffle coil tube located between the exterior of the fire tube and the interior surface of the lower portion of the vessel, the helical baffle coil tube having an inlet connected to the weak solution outlet for receiving a refrigerant solution and an outlet for transferring the refrigerant solution from the vessel.

* * * * *